US007810897B2

(12) United States Patent
Tanaka et al.

(10) Patent No.: US 7,810,897 B2
(45) Date of Patent: Oct. 12, 2010

(54) DROPLET EJECTION APPARATUS AND CLEANING METHOD OF A DROPLET RECEIVING SURFACE

(75) Inventors: Arichika Tanaka, Kanagawa (JP); Hiroaki Satoh, Kanagawa (JP); Masahiko Sekimoto, Kanagawa (JP); Satoshi Mohri, Kanagawa (JP); Toru Nishida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 916 days.

(21) Appl. No.: 11/704,594

(22) Filed: Feb. 9, 2007

(65) Prior Publication Data

US 2007/0257955 A1 Nov. 8, 2007

(30) Foreign Application Priority Data

May 8, 2006 (JP) ..... 2006-129616

(51) Int. Cl.
*B41J 2/015* (2006.01)

(52) U.S. Cl. ..... 347/21

(58) Field of Classification Search ..... 347/21, 347/22, 28, 103

See application file for complete search history.

(56) References Cited

U.S. PATENT DOCUMENTS 6,447,113 B1 * 9/2002 Silverbrook et al. ..... 347/103
7,486,914 B2 * 2/2009 Kabata et al. ..... 399/159

FOREIGN PATENT DOCUMENTS

JP 2004-196505 7/2004

* cited by examiner

*Primary Examiner*—An H Do
(74) *Attorney, Agent, or Firm*—Fildes & Outland, P.C.

(57) ABSTRACT

A droplet ejection apparatus includes: a droplet ejection head that ejects droplets; a conveying member that retains a recording medium and conveys the recording medium with facing the recording medium to the droplet ejection head; a coating member that coats the conveying member with a lubricant; and a cleaning member that cleans the conveying member. The droplet ejection apparatus satisfies the following formulae (1)

$$L2 \geqq L1 \quad (1)$$

wherein, in the formulae (1): L1 is the width, in the direction orthogonal to the conveying direction, of the cleaning of the conveying member by the cleaning member; and L2 is the width, in the direction orthogonal to the conveying direction, of coating the lubricant on the conveying member by the coating member.

16 Claims, 12 Drawing Sheets

DROPLET EJECTION APPARATUS AND CLEANING METHOD OF A DROPLET RECEIVING SURFACE

CROSS-REFERENCE TO RELATED APPLICATION

This application is based on and claims priority under 35 USC 119 from Japanese Patent Application No. 2006-129616 filed on May 8, 2006.

BACKGROUND

1. Technical Field

The present invention relates to a droplet ejection apparatus that carries out cleaning of a member to which droplets that have been ejected from a droplet ejection head adhere, and to a cleaning method of a droplet adhered surface.

2. Related Art

If paper jams occur during printing in an inkjet printer serving as a droplet ejection apparatuses, then ink droplets are ejected from inkjet recording heads (droplet ejection heads) in a state in which there is no paper on the conveying belt (conveying member), and ink may be adhered to the conveying belt. Also, if dummy jetting, ejecting ink droplets that are not related to printing but undertaken in order to prevent blockages in unused nozzles, is carried out towards the conveying belt, then ink may adhere to the conveying belt. Therefore, it is necessary to create a cleaning device for cleaning ink adhered to the conveying belt.

SUMMARY

A first aspect of the present invention provides a droplet ejection apparatus including: a droplet ejection head that ejects droplets; a conveying member that retains a recording medium and conveys the recording medium with facing the recording medium to the droplet ejection head; a coating member that coats the conveying member with a lubricant; and a cleaning member that cleans the conveying member, the droplet ejection apparatus satisfying the following formulae (1)

$$L2 \geqq L1 \quad (1)$$

wherein, in the formulae (1): L1 is the width, in the direction orthogonal to the conveying direction, of the ink droplet ejecting of the droplet ejection head; and L2 is the width, in the direction orthogonal to the conveying direction, of coating the lubricant on the conveying member by the coating member.

BRIEF DESCRIPTION OF THE DRAWINGS

Exemplary embodiments of the present invention will be described in detail based on the following figures, wherein.

DETAILED DESCRIPTION

Explanation will now be given of a first exemplary embodiment of the present invention, while referring to the diagrams.

Figure 1:
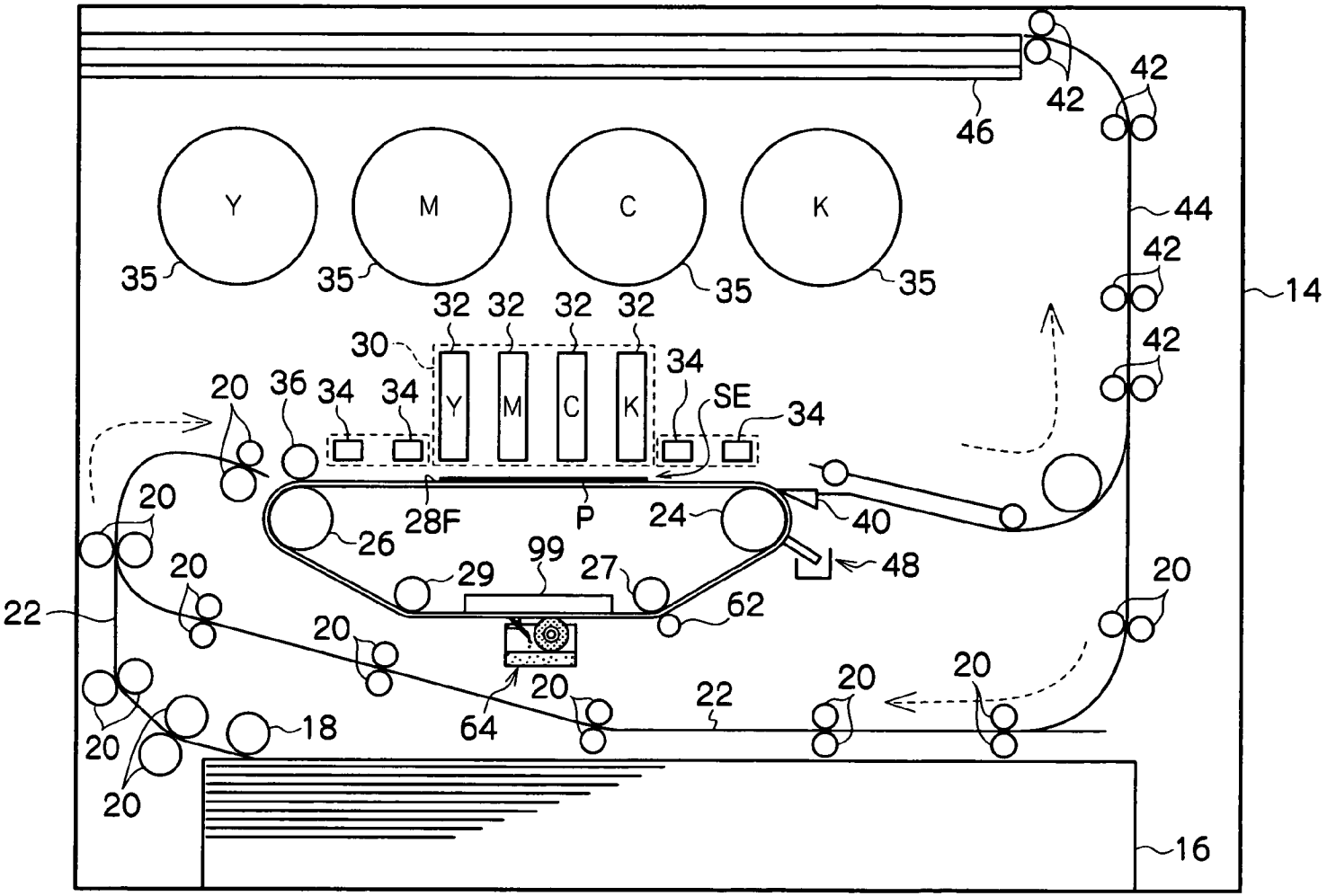
FIG. 1 is a side elevation showing the outline of an inkjet recording apparatus of a first exemplary embodiment of the present invention.

In FIG. 1 is shown, as the liquid ejection apparatus of the present exemplary embodiment, an inkjet recording apparatus 12. In the lower portion of the case 14 of the inkjet recording apparatus 12 is provided a paper supply tray 16. The paper P stacked inside can be fed out one sheet at a time therefrom by a pick up roll 18. The fed out paper P is conveyed along a conveying path 22 configured by plural conveying roller pairs 20.

Above the paper supply tray 16, an endless conveying belt 28 is entrained around a driving roll 24, and driven rolls 26, 27 and 29 as a conveying member. The driving roll 24 and the driven roll 26 are arranged in a substantially horizontal plane, and below these are arranged the driven rolls 27 and 29, again arranged in a substantially horizontal plane.

Further, above the conveying belt 28 is disposed a recording head array 30, facing a flat portion 28F of the conveying belt 28 between the driving roll 24 and the driven roll 26. This opposing region is the ejection region SE where ink droplets are ejected from the recording head array 30. Paper P conveyed on the conveying path 22 is held and supported on the conveying belt 28 to reach the ejection region SE, and, in a state of opposing the recording head array 30, ink droplets from the recording head array 30 are adhered to the paper P according to image information.

In the present exemplary embodiment the recording head array 30 is a rectangular shape having an effective recording region that is the width of the paper P or greater (the dimension of the paper P in the direction orthogonal to the conveying direction), and the recording head array 30 has four inkjet recording heads 32 arranged in the conveying direction as four droplet ejection heads (referred to below as recording heads). The corresponding colors thereof are yellow (Y), magenta (M), cyan (C), and black (K), and full color image recoding may be made therewith.

Each of the recording heads 32 is driven by a head driving circuit (not illustrated). The head driving circuit, for example, is configured to determine the ejection timing of ink droplets according to the image information and the ink ejection aperture (nozzle) to be used, and sends a driving signal to the recording head 32.

The recording head array 30 may be immovable in the direction orthogonal to the conveying direction, but by structuring to be movable as the need arises, recording of a higher resolution may be made by image recording using multi-pass, and the influence of deficiencies in the recording head 32 on the recording result may be avoided.

Figure 2:
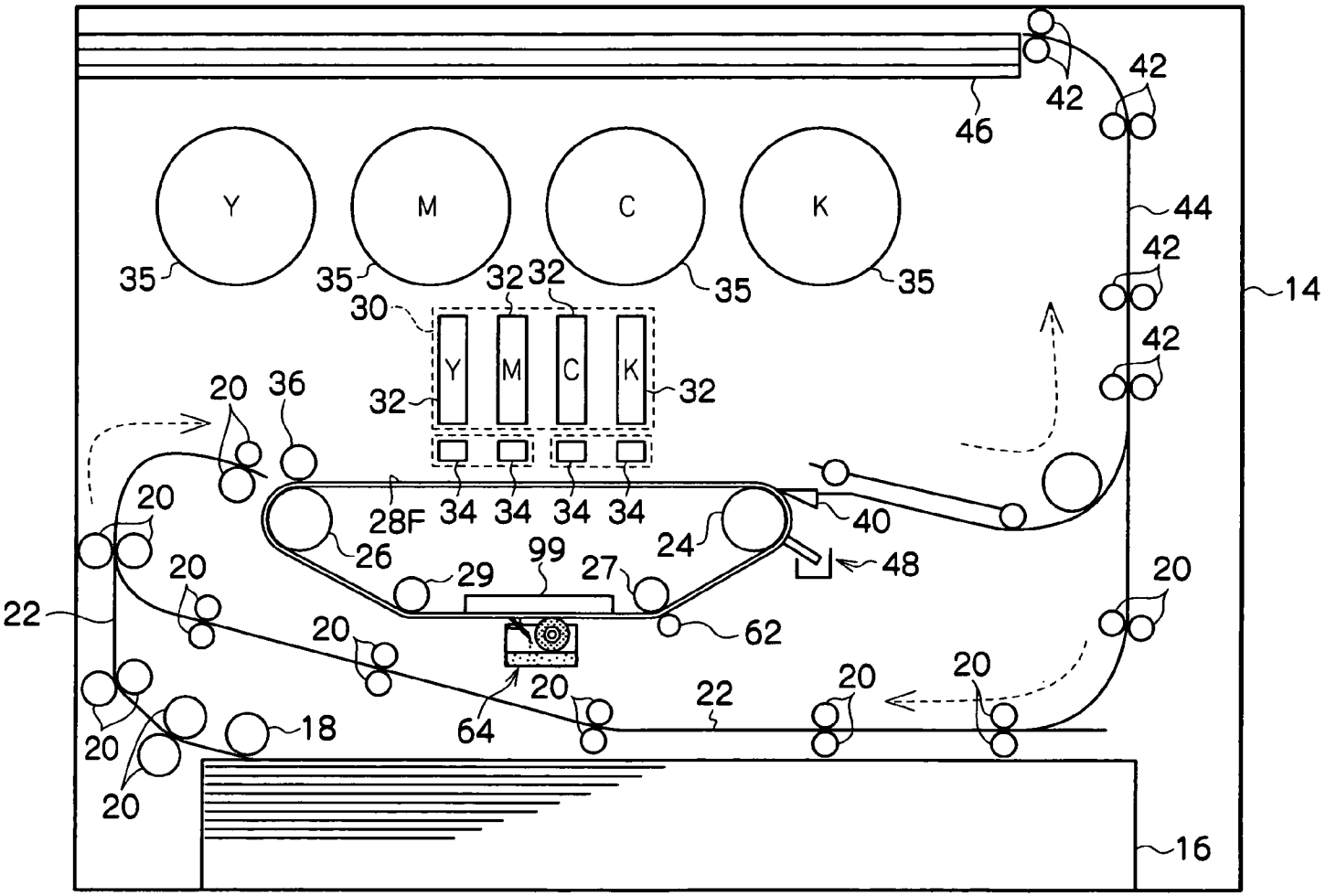
FIG. 2 is a side elevation showing the outline of an inkjet recording apparatus of the first exemplary embodiment of the present invention.

Four maintenance units 34, corresponding to each of the recording heads 32, are arranged at the sides of the recording head array 30. As can be seen in FIG. 2, when maintenance is carried out on the recording heads 32, the recording head array 30 is moved upward, and the maintenance units 34 are moved to enter into the space between the conveying belt 28 and the recording head array 30. Then, in the state in which the nozzle face is opposing the maintenance units 34, specific maintenance operations (such as suctioning, wiping, capping), are carried out.

Further, ink tanks 35 that store inks of each of the colors are disposed above the recording head array 30. Each of the ink tanks 35 are connected to its respective recording head 32.

Figure 3:
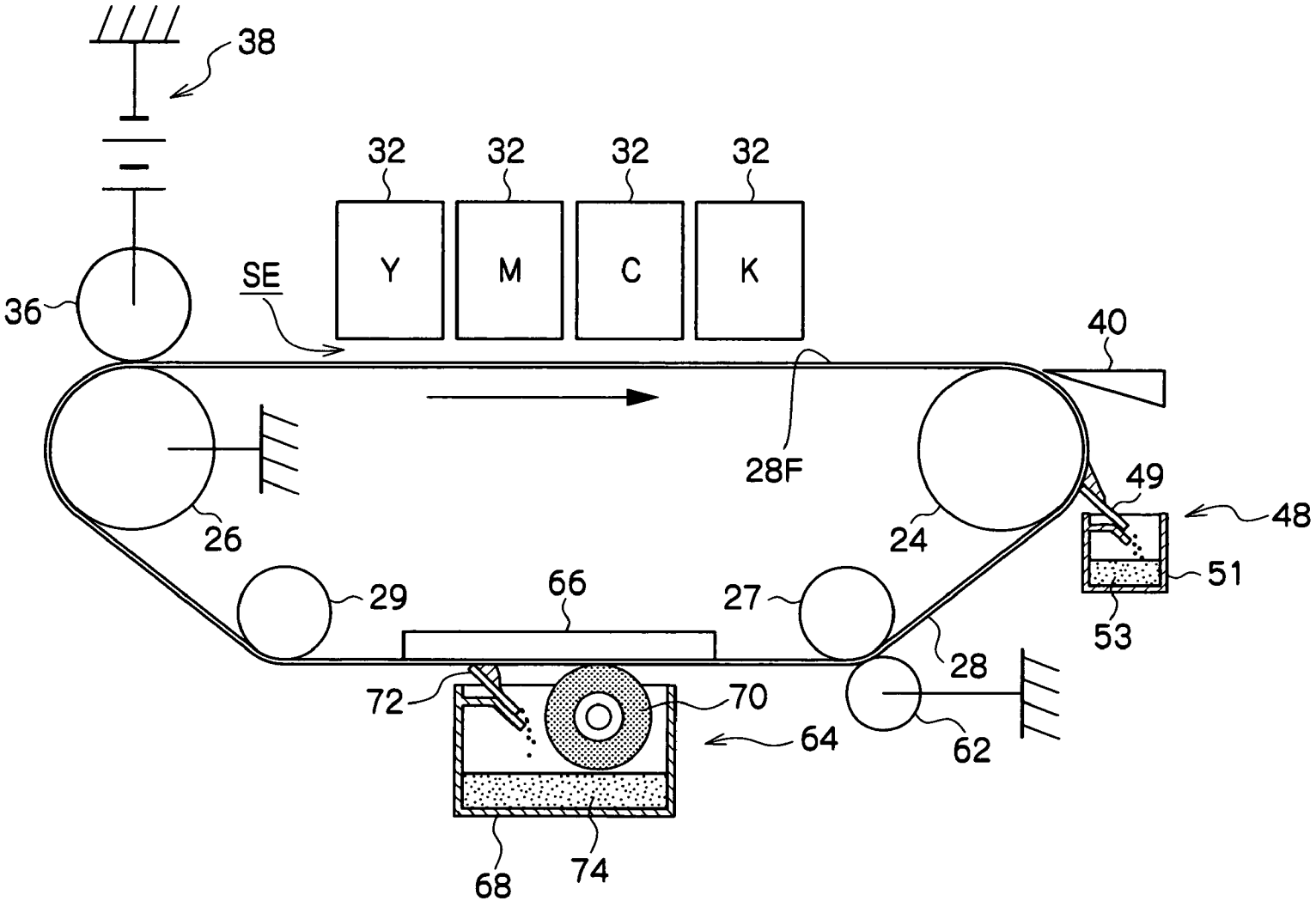
FIG. 3 is a side elevation showing a printing unit of an inkjet recording apparatus of the first exemplary embodiment of the present invention.

As shown in FIG. 3, on the upstream side of the recording head array 30 a charging roll 36 connected to a power source 38 is disposed as a charging unit. The charging roll 36 sandwiches the conveying belt 28 and the paper P between itself and the driven roll 26, and is driven, pressing the paper P onto the conveying belt 28. At this time, since a specific voltage difference to that of the driven roll 26 is generated, charge may be applied to the paper P and paper P may be electrostatically attracted onto the conveying belt 28.

On the downstream side of the recording head array 30 is disposed a releasing scraper 40 that releases the paper P from the conveying belt 28. The released paper P is conveyed by plural ejection roller pairs 42 configuring an discharge path 44 on the downstream side of the releasing scraper 40, and discharged into an discharge paper tray 46 provided at the upper portion of the case 14.

Also, below the releasing scraper 40 is disposed a belt cleaning unit 48. The belt cleaning unit 48 is provided with a blade 49 as a cleaning member, and a recovery box 51 into which is recovered ink and the like that is scraped off the conveying belt 28 by the blade 49. The blade 49 contacts with a portion of the conveying belt 28 that is wrapped around the driving roll 24, and scrapes off ink and the like that is adhered to the conveying belt 28. An absorbent member 53 is spread out in the bottom portion of the recovery box 51, and absorbs liquid that drops off from the blade 49.

On the downstream side of the belt cleaning unit 48 is disposed a grounded charge removal roll 62, as a charge removal unit. The charge removal roll 62 sandwiches the conveying belt 28 between itself and the driven roll 27, and is driven, removing the charge on the conveying belt 28.

An oil coating unit 64 and a back up plate 66 are provided between the driven roll 26 and the driven roll 27, facing the conveying belt 28 therebetween. The oil coating unit 64 faces the outer peripheral surface of the conveying belt 28, and the back up plate 66 contacts with the inner peripheral surface of the conveying belt 28.

The oil coating unit 64 is provided with: a case 68; an oil coating roll 70, as a coating member, rotatably supported in the case 68; and an oil blade 72 supported by the case 68. The oil coating roll 70 is pressed by the back up plate 66 through the intervening conveying belt 28, and rotated by being driven by the conveying belt 28. Also, the oil coating roll 70 is formed of a porous body of polyethylene, urethane or the like, impregnated with silicone oil as a lubricant, and coats the conveying belt 28 with silicone oil. Therefore, the is a silicone oil film present between the conveying belt 28 and the blade 49, and so friction is relieved between the conveying belt 28 and the blade 49.

Further, the ink that is ejected from the recording heads 32 is a water based ink. Therefore, if ink adheres to the conveying belt 28 due to unnecessary ink ejection when there is a paper jam, or due to dummy jetting or the like ejecting ink onto the conveying belt 28, then ink may be cohered by the water repellant effect of the film of silicone oil on the conveying belt 28. Therefore, increase in the adhering force of the ink to the conveying belt 28 may be suppressed, and when cleaning the conveying belt 28 with the blade 49, ink may be easily separated from the conveying belt 28.

Here, it is effective to always form a film of silicone oil on the conveying belt 28, as in the present exemplary embodiment, so that dummy jetting may be carried out at short periods such as one time every several tens of seconds, in order to prevent increase in the viscosity of ink in the recording heads 32.

A driving roll may be used for the oil coating roll 70. In such a case, slipping of the oil coating roll 70 relative to the conveying belt 28 may be prevented.

The oil blade 72 contacts the conveying belt 28 at a position that is at the downstream side of the oil coating roll 70 in the rotation direction of the conveying belt 28, and scrapes off excess silicone oil coated onto the conveying belt 28 to give a specific thickness of silicone oil film. The oil blade 72 may use rubber materials such as a flurorubber, NBR or the like, thin metal plate such as SUS (stainless steel) or the like, or resin films such as polyurethane, PET or the like.

The bottom portion of the case 68 is covered with absorbent material 74 such as sponge, and this absorbent material 74 absorbs the silicone oil scraped off from the conveying belt 28 by the oil blade 72.

The conveying belt 28 may be formed of resins such as PET, PI, PA and the like, or rubber materials such as CR, NBR, HNBR, urethane rubber and the like, and coating treatment may be carried out on the surface thereof. Also, the blade 49 may be formed of rubber materials such as a flurorubber, NBR, HNBR or the like, thin metal plate such as SUS (stainless steel) or the like, or resin films such as polyurethane, PET or the like. Also, the roll portion of the oil coating roll 70 may be appropriately formed of a non-woven fabric formed from polyester, polyamide or the like, but as long as a predetermined amount of ink is able to penetrate therein, and wrapping around is possible, then other materials may be substituted.

As mentioned above a silicone oil may be used as the lubricant that is coated on the conveying belt 28 by the oil coating roll 70 (referred to below as lubricant), and a water based ink may be used. Here, considering the cleaning properties of the conveying belt by the blade 49, a lubricant that repels the ink is appropriate, and for a water based ink, as well as a silicone oil, the following may be used: higher fatty acids, such as oleic acid, linoleic acid and the like; plasticizers such as dibutylphthalate, diisodecylphthalate, dibutylmaleate and the like; non water soluble alcohols such as n-decanol, dimethylbutanol and the like; and liquids that have water repellant properties such as fluoro oils, mineral oils, vegetable oils and the like. Also, for oil based inks, a liquid with high oil repellant properties may be used, such as water.

Also, in order to stabilize the coating of the lubricant on the conveying belt 28, it is preferable that the dynamic viscosity of the lubricant is in the range of 10 to $10^4$ $mm^2/s$, and more preferably in the range of 50 to $10^2$ $mm^2/s$.

If the thickness of coating of the lubricant is too thick, then the oil may penetrate into the paper P and this may lead to a detrimental effect on the quality of the image, such as the paper P repelling the ink and the like. On the other hand, if the thickness of the coating of the lubricant is too thin then it may not be possible to relieve the friction between the blade 49 and the conveying belt 28, and further it may not be possible to carry out good cleaning by the blade 49. It is, therefore, necessary to set the thickness of coating the lubricant to within an appropriate range. An appropriate range for the coating thickness of the lubricant is 1 nm to 20 μm.

Also, it is necessary that the lubricant is not volatile at room temperature. Specifically, the vapor pressure at 25° C. should be 13.33 Pa or less. Also, it is necessary that the lubricant is not compatible with the ink. Specifically, the solubility to ink should be 0.1 wt % or less at room temperature (25° C.).

Figure 4:
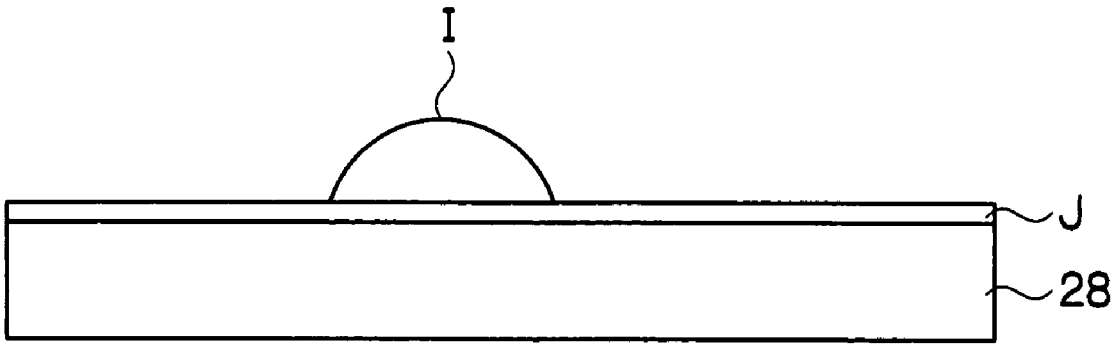
FIG. 4 is an enlarged cross section showing a conveying belt provided in an inkjet recording apparatus of the first exemplary embodiment of the present invention.

It is necessary, also, so that the lubricant wets out the conveying belt 28, that formula (A) below is satisfied. Here, as shown in FIG. 4, the surface tension of the lubricant J is designated $\gamma_o$, and the critical surface tension of the conveying belt 28 is designated $\gamma_b$. The critical surface tension is the surface tension, in the relationship of the solid surface contact angle θ to the surface tensions of various liquids, when cosθ is adjusted to 1 (that is when the contact angle of the liquid to the solid surface becomes 0°). In general, solid surfaces are well wetted by liquids that have a surface tension that is smaller than the critical surface tension of the surface.

$$\gamma_o<\gamma_b \quad (A)$$

Further, in order for the lubricant J to have water repellant properties it is necessary that the formula (B) below is satisfied. Here the surface tension of the ink I is designated $\gamma_i$.

$$\gamma_o<\gamma_i \quad (B)$$

By doing so, ink I does not wet out onto the surface of the film of lubricant J, but coheres. In experimentation for evaluating the cleaning properties of a PET belt of critical surface tension $\gamma_b$ of 43 [mN/m], as the conveying belt 28, a silicon oil of a surface tension $\gamma_o$ of 20 [mN/m], as the lubricant, and water based ink with a surface tension $\gamma_i$ of 30 [mN/m] as the ink, it is seen that there are no remnants of the ink on the conveying belt 28 and there is good cleaning.

Here, in order that there is cleaning such that there are no droplets of ink remaining adhered to the conveying belt 28, it is necessary that ink droplets ejected towards the conveying belt 28 from the recording head 32 always impact onto the film of silicone oil on the conveying belt 28, and then also necessary that cleaning is carried out by the blade 49 for all of the ink droplets impacted onto the film of silicone oil.

In order to maintain the reliability of the conveying belt 28 and the blade 49 for a long period, and in order to suppress variations in the load imparted on the conveying belt 28 by the blade 49, the friction between the conveying belt 28 and the blade 49 needs to be relieved across the whole of its width in the direction orthogonal to the conveying direction.

Figure 5:
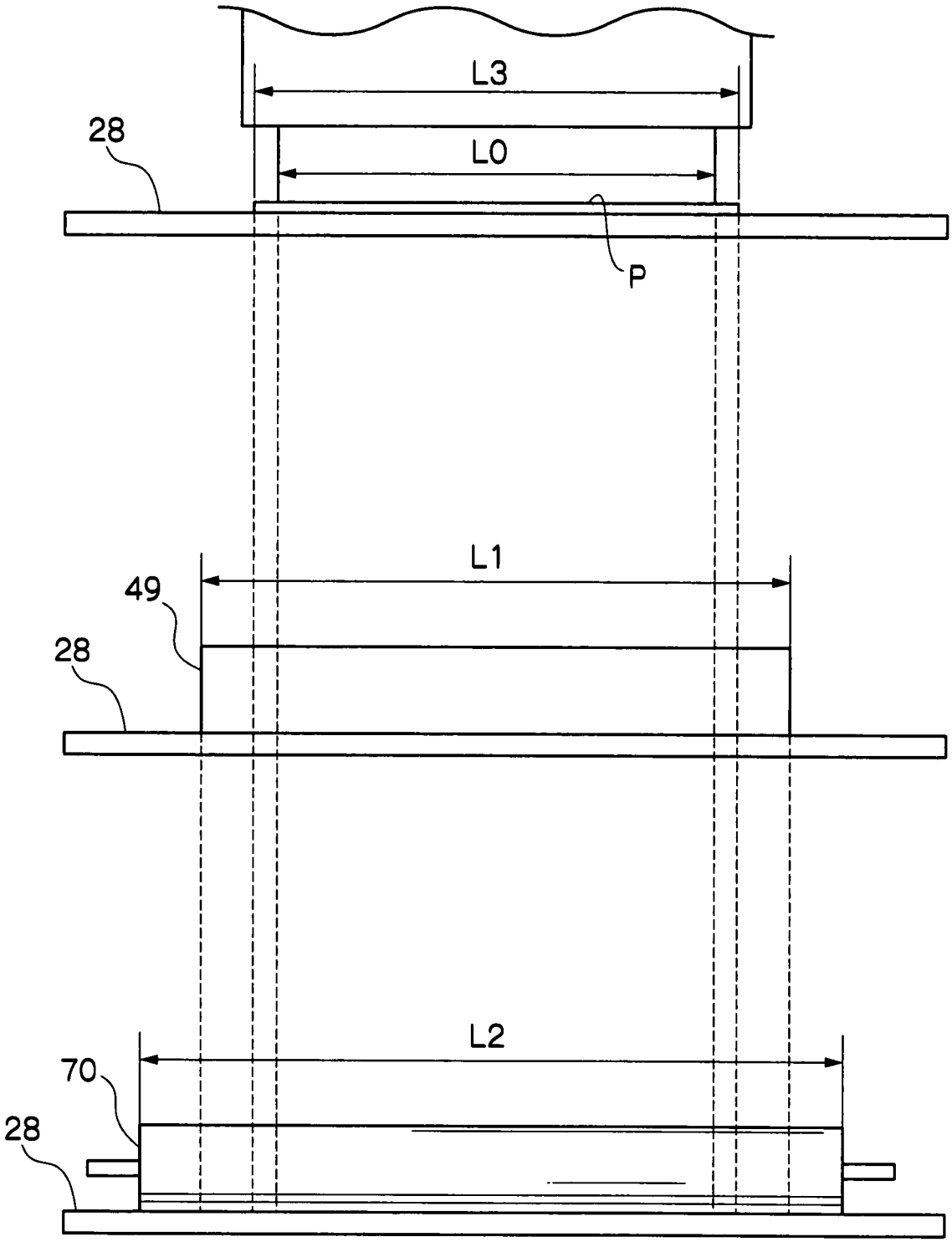
FIG. 5 is a diagram showing, the relationship between the maximum printing width of a recording head L0, the cleaning width of a blade L1, the coating width of a oil coating roll L2, and the paper width L3, in an inkjet recording apparatus of the first exemplary embodiment of the present invention.

For this, as is shown in FIG. 5, the maximum value L0 of the width, in the direction orthogonal to the conveying direction, of the ink droplet ejecting of the recording head 32 (referred to below as the maximum printing width), and the width L1, in the direction orthogonal to the conveying direction, of the cleaning of the conveying belt 28 by the blade 49 (referred to below as the cleaning width), the width L2, in the direction orthogonal to the conveying direction, of coating the silicone oil on the conveying belt 28 by the oil coating roll 70 (referred to below as the coating width) should satisfy the formula below (1). The cleaning width L1 is equivalent to the width, in the direction orthogonal to the conveying direction, of contact between the blade 49 and the conveying belt 28, and the coating width L2 is equivalent to the width, in the direction orthogonal to the conveying direction, of contact between the oil coating roll 70 and the conveying belt 28.

$$L2 \geqq L1 \geqq L0 \quad (1)$$

By the cleaning width L1 of the blade 49 being the same as or greater than the maximum printing width L0 of the recording head 32, cleaning by the blade 49 is carried out over the complete region of the silicone oil film on the conveying belt 28 to which ink droplets have adhered.

By the coating width L2 of the oil coating roll 70 being the same as or greater than the maximum printing width L0 of the recording head 32, there is the silicone oil film between the conveying belt 28 and all of the ink droplets on the conveying belt 28, and increase may be prevented in the adhering force of all of the ink droplets on the conveying belt 28 to the conveying belt 28. Therefore, good cleaning of the conveying belt 28 may be carried out such that there are no remnants of the ink on the conveying belt 28.

Further, by the coating width L2 of the oil coating roll 70 being the same as or greater than the cleaning width L1 of the blade 49, there is the silicone oil film between the conveying belt 28 and the blade 49 across the entire region of the direction orthogonal to the conveying direction of the conveying belt 28, and friction may be relieved between the conveying belt 28 and the blade 49, Therefore, damage of the conveying belt 28 and the blade 49 may be suppressed, and the reliability of the conveying belt 28 and the blade 49 can be improved, also changes in the load imparted to the conveying belt 28 by the blade 49 may be suppressed.

In this exemplary embodiment the coating width L2 and the cleaning width L1 are longer than the maximum printing width L0, and the coating width L2 is longer than the cleaning width L1.

In order to prevent soiling of the paper P due to ink mist adhering to the conveying belt 28, it is necessary that the width L3 of the paper P in the direction orthogonal to the conveying direction (referred to below as the paper width) and the cleaning width L1 satisfy the following formula (2).

$$L1 \geqq L3 \quad (2)$$

By the cleaning width L1 being the same as or greater than the paper width L3, ink mist adhered in the region of contact between the paper P and the conveying belt 28 is completely scraped off by the blade 49, and so soiling of the paper P by ink mist adhered to the conveying belt 28 may be prevented.

Figure 6:
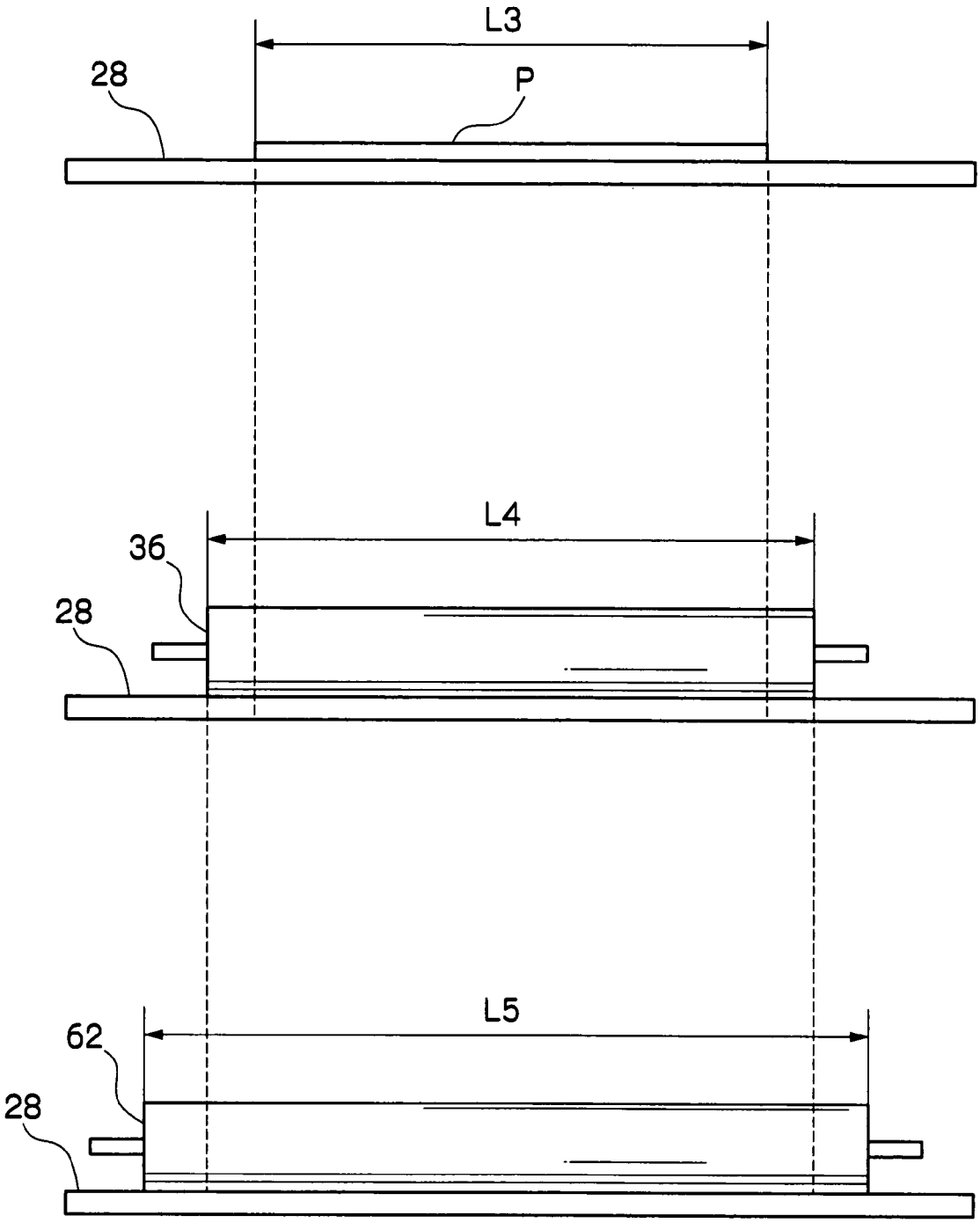
FIG. 6 is a diagram showing the relationship between the paper width L3, the charging width of a charging roll L4, and the charge removing width of a charge removing roll L5 in an inkjet recording apparatus of the first exemplary embodiment of the present invention.

As shown in FIG. 6, in order to convey the paper P in a stable manner with the conveying belt 28, the paper width L3 and the width of the charging roll 36 charging the conveying belt 28 in the direction orthogonal to the conveying direction (referred to below as the charging width) L4, are required to satisfy formula (3) below. The charging width L4 of the charging roll 36 is equivalent to the width of contact of the charging roll 36 and the conveying belt 28 in the direction orthogonal to the conveying direction.

$$L4 \geqq L3 \quad (3)$$

By the charging width L4 of the charging roll 36 being the same or greater than the paper width L3, the whole width of the paper P may be electrostatically attracted onto the conveying belt 28, and the paper P may be stably conveyed by the conveying belt 28. In the present exemplary embodiment the charging width L4 is wider than the paper width L3.

If there is a region where no charge removal is carried out by the charge removal roll 62 on the conveying belt 28, then in such a region, dust adherence and sparking may occur. Also, the electrostatic attraction between such a region and the recording heads 32 can increase abnormally, and contact may occur between the recording heads 32 and the conveying belt 28.

It is preferable, therefore, that the charge on the conveying belt 28 is completely removed by the charge removal roll 62, and so it is necessary that the charging width L4 of the charging roll 36 and the width L5, in the direction orthogonal to the conveying direction, of the removal of the charge from the conveying belt 28 by the charge removal roll 62 (referred to below as the charge removal width) satisfies the formula (4) below.

$$L5 \geqq L4 \quad (4)$$

By the charge removal width L5 of the charge removal roll 62 being the same as or greater than the charging width L4 of the charging roll 36, charge may be removed from all of the region of the conveying belt 28 that is charged by the charging roll 36, and various problems that are caused by charge remaining on the conveying belt 28 may be suppressed. In the present exemplary embodiment the charge removal width L5 is wider that the charging width L4.

Next explanation will be given of a second exemplary embodiment. Structures that are similar to those of the first exemplary embodiment will be allocated the same numerals and explanation thereof will be omitted.

Figure 7:
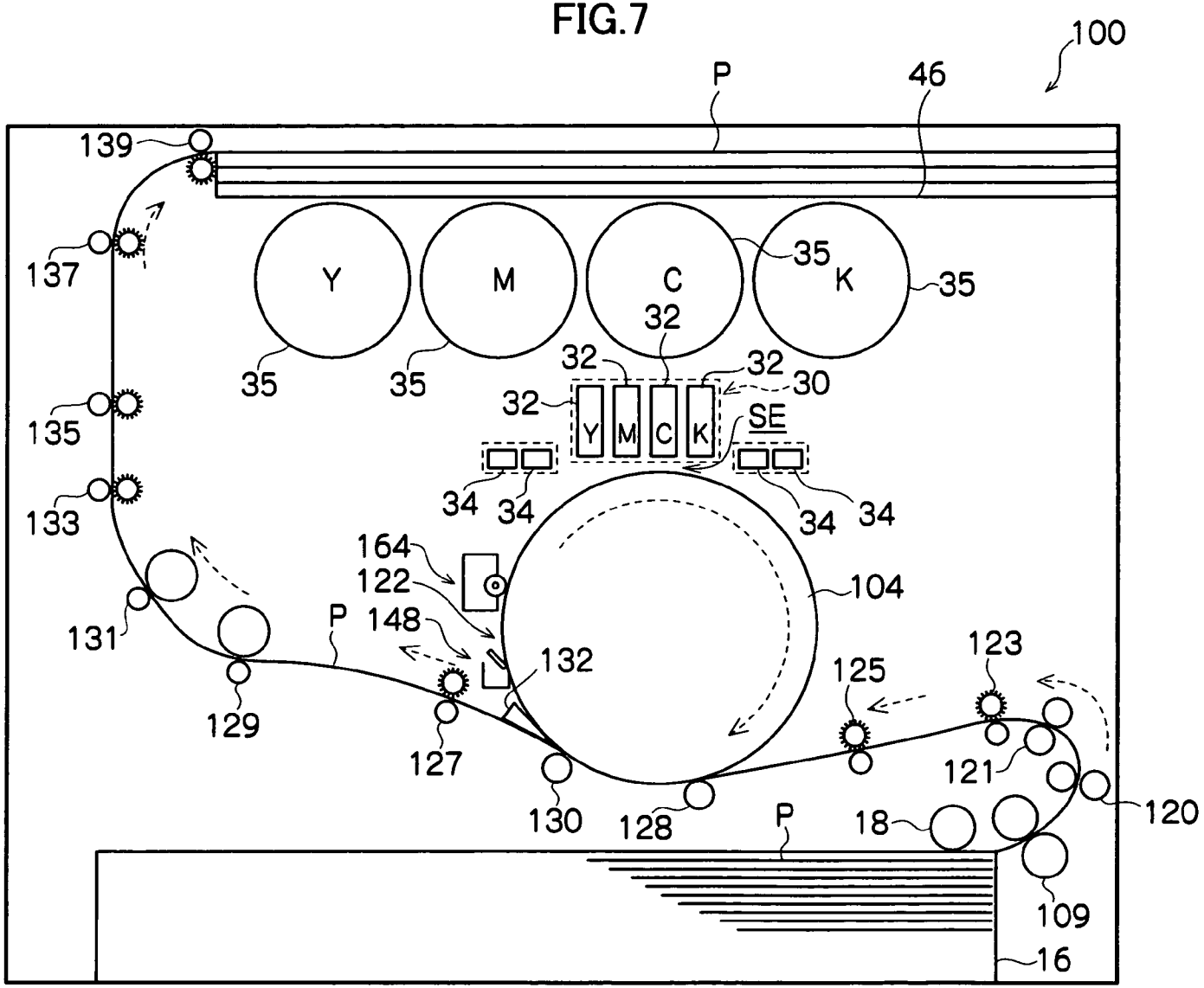
FIG. 7 is a side elevation showing the outline of an inkjet recording apparatus of a second exemplary embodiment of the present invention.
Figure 8:
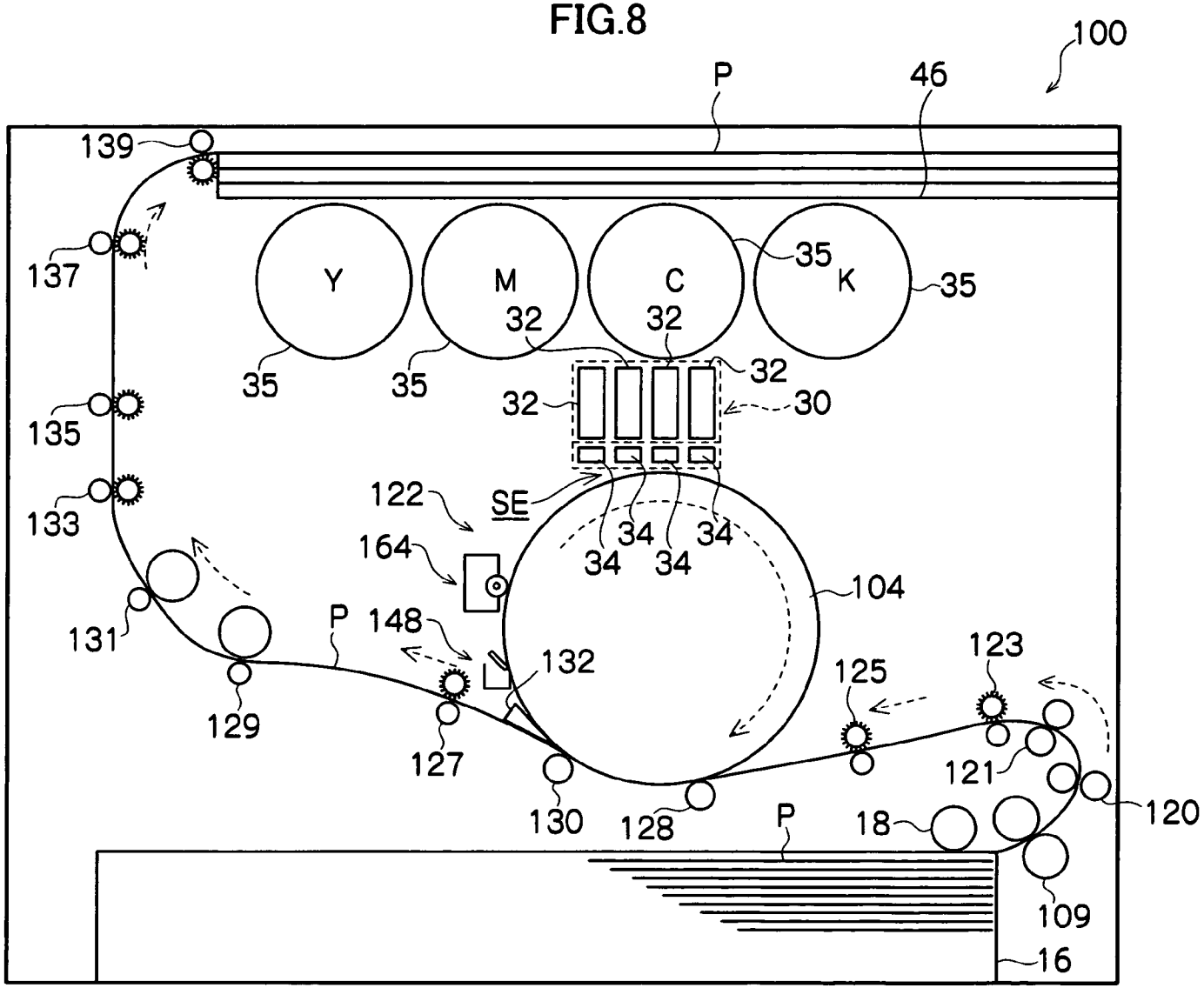
FIG. 8 is a side elevation showing the outline of an inkjet recording apparatus of the second exemplary embodiment of the present invention.

As shown in FIG. 7 and FIG. 8, the ink jet recording apparatus 100, as a droplet ejection apparatus of the present exemplary embodiment, is a full color printer for forming a full color image on paper P with four colors of ink, yellow (Y), magenta (M), cyan (C), and black (K). The ink jet recording apparatus 100 is a printer using an offset method, and by ejecting ink towards an intermediate transfer drum 104 as a holding member (carrier), first forms an ink image on the intermediate transfer drum 104, and then transfers the ink image from the intermediate transfer drum 104 to the paper P.

At a lower portion of ink jet recording apparatus 100 is provided a removable paper supply tray 16. Paper P is stacked in the paper supply tray 16, and the uppermost of paper P is in contact with a pick up roll 18. Paper P may be supplied one sheet at a time by the pick up roll 18 at the downstream side of the conveying direction, and supplied to an image forming unit 122 by pairs of conveying rolls 109, 120, 121, 123, and 125 disposed in the above order along a conveying path. The rolls of conveying rolls 123, 125 that contact the face of paper P to which the ink image is transferred are star wheels.

In the image forming unit 122 the intermediate transfer drum 104 is disposed facing the conveying path, and a recording head array 30 is disposed above the intermediate transfer drum 104, and maintenance units 34 are also disposed in the vicinity of the recording head array 30.

The recording head array 30, as shown in FIG. 7, is in the vicinity of the intermediate transfer drum 104 when ejecting ink. Also, as shown in FIG. 8, when maintaining, the recording head array 30 is distanced from the intermediate transfer drum 104 and a space between the recording head array 30 and the intermediate transfer drum 10 for inserting the maintenance units 34 may be secured.

Also, as shown in FIG. 7, the maintenance units 34, when forming an image, recede to the outside of the ejection region SE where ink droplets are ejected from the recording head array 30. And, as shown in FIG. 8, when not forming an image, the maintenance units 34 are introduced into the ejection region SE.

Further, as shown in FIGS. 7 and 8, contacting the intermediate transfer drum 104 at the conveying path side, are a charging roll 128 as a transfer unit, a charge removing roll 130 as a transfer unit, and a releasing scraper 132, in that order from the upstream side in the conveying direction. The charging roll 128 presses the paper P against the intermediate transfer drum 104 and applies a charge to the paper P, and the paper P is attracted by electrostatic attraction to the intermediate transfer drum 104, and an ink image is transferred to the paper P. Further, the charge removing roll 130 conveys the paper P while removing the charge from the paper P, and releases the electrostatic attraction between the paper P and the intermediate transfer drum 104. Then, the releasing scraper 132 releases the paper P from the intermediate transfer drum 104.

Then, downstream in the conveying direction of the releasing scraper 132, are disposed conveying roll pairs 127, 129, 131, 133, 135, 137, and 139, in that order from the upstream side in the conveying direction. The conveying rolls of the conveying roll pairs 127, 133, 135, 137, and 139 that contact the face of the paper P on which the ink image has been transferred are star wheels, and contact with the face of the paper P on which the ink image has been transferred is reduced.

Above the ink tanks 35 is disposed a discharge tray 46, and at the side of the discharge tray 46 is disposed the conveying roller pair 139. The paper P is ejected into the discharge tray 46 by the conveying roller pair 139.

Figure 9:
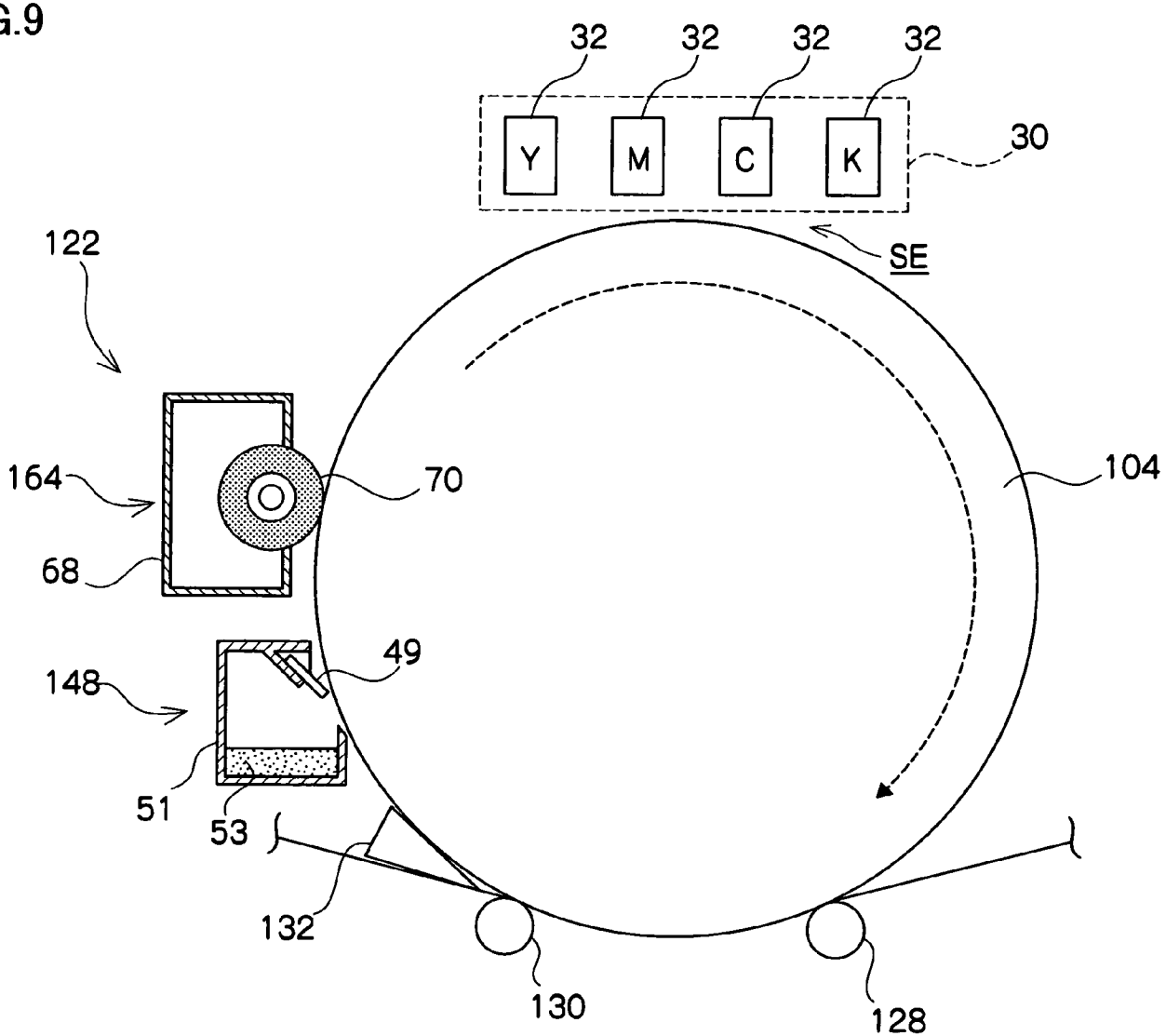
FIG. 9 is a side elevation showing a printing unit of an inkjet recording apparatus of the second exemplary embodiment of the present invention.

As shown in FIG. 9, a drum cleaning unit 148 is disposed further to the downstream side in the rotation direction of the intermediate transfer drum 104 than the releasing scraper 132 and further to the upstream side in the rotation direction of the intermediate transfer drum 104 than the recording head array 30. This drum cleaning unit 148 is equipped with a blade 49 as a cleaning unit which contacts the peripheral surface of the intermediate transfer drum 104, scrapes off ink and the like that has not been transferred to the paper P and remains on the intermediate transfer drum 104; and a recovery box 51 that recovers the ink and the like that has been scraped off from the intermediate transfer drum 104 by the blade 49. An absorbent member 53 is spread out at the bottom of the recovery box 51, and liquid that drips down from the blade 49 is absorbed thereby.

Also, an oil coating unit 164 is disposed downstream in the rotation direction of the intermediate transfer drum 104 of the blade 49, and downstream in the rotation direction of the intermediate transfer drum 104 of the recording head array 30. The oil coating unit 164 is provided with a case 68 and an oil coating roll 70, as a coating unit, rotatably supported by the case 68. The oil coating roll 70 is pressed by the intermediate transfer drum 104, and rotated by being driven by the intermediate transfer drum 104. Also, the oil coating roll 70 is formed of a porous body of polyethylene, urethane or the like, impregnated with silicone oil as a lubricant, and coats the intermediate transfer drum 104 with silicone oil. Due to this there is a film of silicone oil between the intermediate transfer drum 104 and blade 49, and friction between the intermediate transfer drum 104 and blade 49 can be relieved.

The ink that is ejected from the recording heads 32 is a water based ink, and therefore, ink may be cohered by the water repellant effect of the film of silicone oil on the intermediate transfer drum 104. Therefore, increase in the adhering force of the ink to the intermediate transfer drum 104 may be suppressed, and when cleaning the intermediate transfer drum 104 with the blade 49, ink may be easily separated from the intermediate transfer drum 104.

A driving roll may be used for the oil coating roll 70. In such a case slipping of the oil coating roll 70 relative to the intermediate transfer drum 104 may be prevented.

Figure 10:
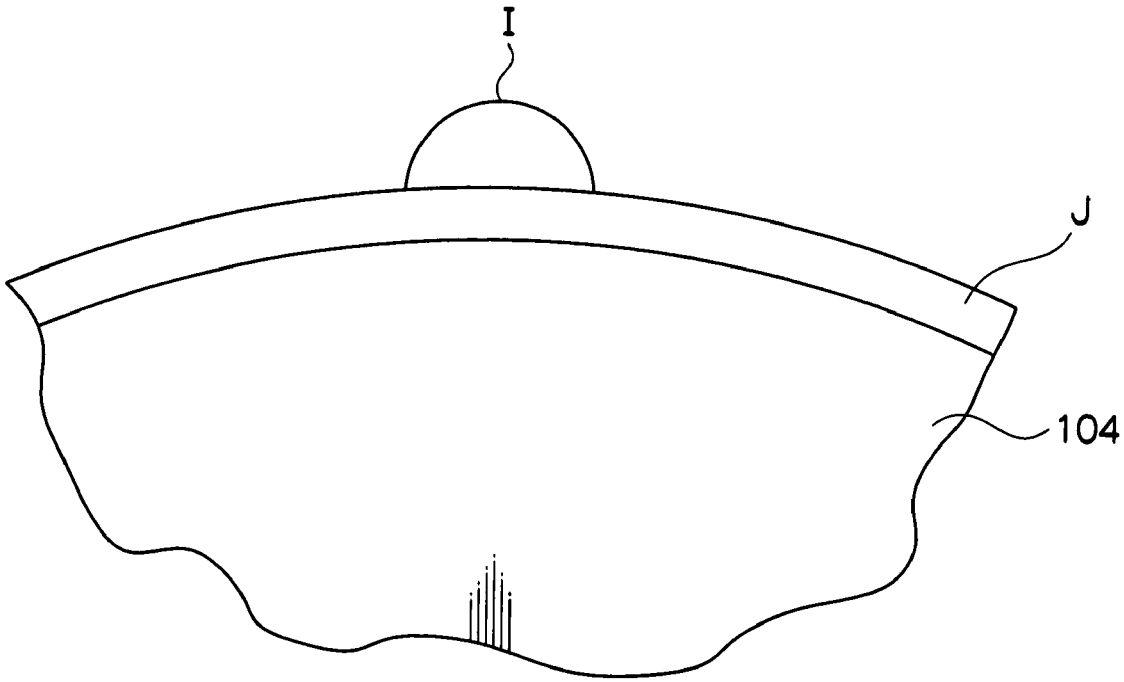
FIG. 10 is an enlarged cross section showing an intermediate transfer drum provided in an inkjet recording apparatus of the second exemplary embodiment of the present invention.

It is necessary that formula (A) below is satisfied, so that the lubricant wets out the intermediate transfer drum 104. Here, as shown in FIG. 10, the surface tension of the lubricant J is designated $\gamma_o$, and the critical surface tension of the intermediate transfer drum 104 is designated $\gamma_b$.

$$\gamma_o<\gamma_b \quad (A)$$

Further, in order for the lubricant J to have water repellant properties it is necessary that the formula (B) below is satisfied. Here the surface tension of the ink I is designated $\gamma_i$.

$$\gamma_o<\gamma_i \quad (B)$$

By doing so, as in the first exemplary embodiment, ink I does not wet out onto the surface of the film of lubricant J, and the ink coheres and becomes easier to scrape off from the intermediate transfer drum 104 by the blade 49.

Here, in order that there is cleaning such that there are no droplets of ink remaining adhered to the intermediate transfer drum 104, first it is necessary to ensure that ink droplets ejected towards the intermediate transfer drum 104 from the recording head 32 always impact onto the film of silicone oil on the intermediate transfer drum 104, and then also necessary to ensure that that cleaning is carried out by the blade 49 for all of the ink droplets impacted onto the film of silicone oil.

In order to maintain the reliability of the intermediate transfer drum 104 and the blade 49 for a long period, and in order to suppress variations in the load imparted on the intermediate transfer drum 104 by the blade 49, the friction between the intermediate transfer drum 104 and the blade 49 needs to be relieved across the whole of its width in the direction orthogonal to the conveying direction.

Figure 11:
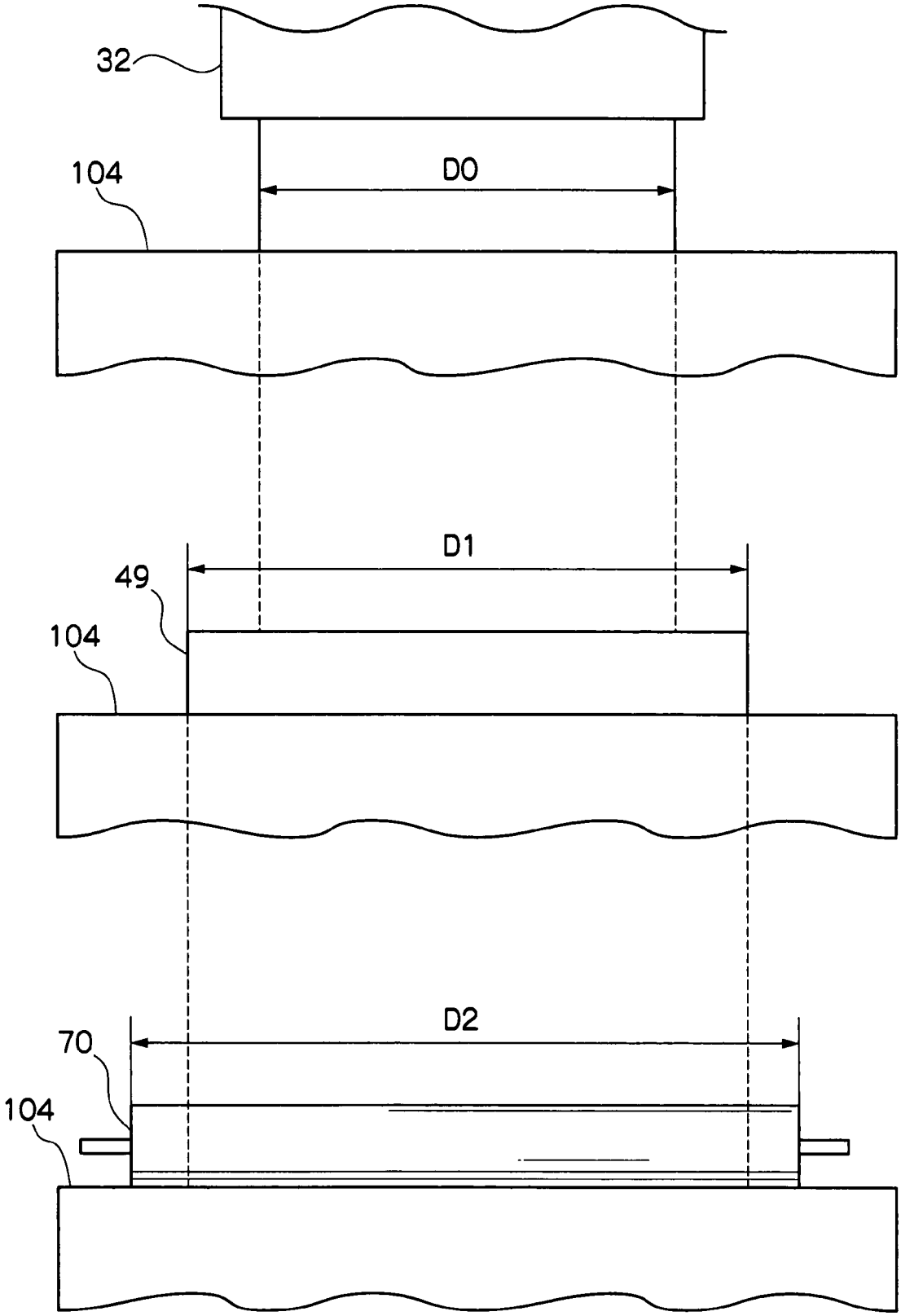
FIG. 11 is a diagram showing the relationship between the maximum printing width of a recording head D0, the cleaning width of a blade D1, and the coating width of an oil coating roll D2 in an inkjet recording apparatus of the second exemplary embodiment of the present invention.

For this, as is shown in FIG. 11, the maximum value D0 of the width, in the direction orthogonal to the conveying direction, of the ink droplet ejecting of the recording head 32 (referred to below as the maximum printing width), and the width D1, in the direction orthogonal to the conveying direction, of the cleaning of the intermediate transfer drum 104 by the blade 49 (referred to below as the cleaning width), and the width D2, in the direction orthogonal to the conveying direction, of coating the silicone oil on the intermediate transfer drum 104 by the oil coating roll 70 (referred to below as the coating width) should satisfy the formulae (5) below. The cleaning width D1 is equivalent to the width, in the direction orthogonal to the conveying direction, of contact between the blade 49 and the intermediate transfer drum 104, and the coating width D2 is equivalent to the width, in the direction orthogonal to the conveying direction, of contact between the oil coating roll 70 and the intermediate transfer drum 104.

$$D2 \geqq D1 \geqq D0 \quad (5)$$

By the cleaning width D1 of the blade 49 being the same as or greater than the maximum printing width D0 of the recording head 32, cleaning is carried out by the blade 49 for all of the region in which ink droplets are adhered to the silicone oil film on the intermediate transfer drum 104.

By the coating width D2 of the oil coating roll 70 being the same as or greater than the maximum printing width D0 of the recording head 32, there is the silicone oil film between all of the ink droplets on the intermediate transfer drum 104 and the intermediate transfer drum 104 itself, and increase may be prevented in the adhering force of all of the ink droplets on the intermediate transfer drum 104 to the intermediate transfer drum 104. Therefore, good cleaning of the intermediate transfer drum 104 may be carried out such that there are no remnants of the ink on the intermediate transfer drum 104.

By the coating width D2 of the oil coating roll 70 being the same as or greater than the cleaning width D1 of the blade 49, there is the silicone oil film between the intermediate transfer drum 104 and the blade 49 over the whole of the region in the direction orthogonal to the conveying direction, and friction between the intermediate transfer drum 104 and the blade 49 can be relieved. Therefore, occurrence of damage between the intermediate transfer drum 104 and the blade 49 can be suppressed, and the reliability of the intermediate transfer drum 104 and the blade 49 can be improved, and variations in the load on the intermediate transfer drum 104 by the blade 49 can be suppressed.

In the present exemplary embodiment coating width D2 and cleaning width D1 are made longer than the maximum printing width D0, and coating width D2 is made longer than cleaning width D1.

Figure 12:
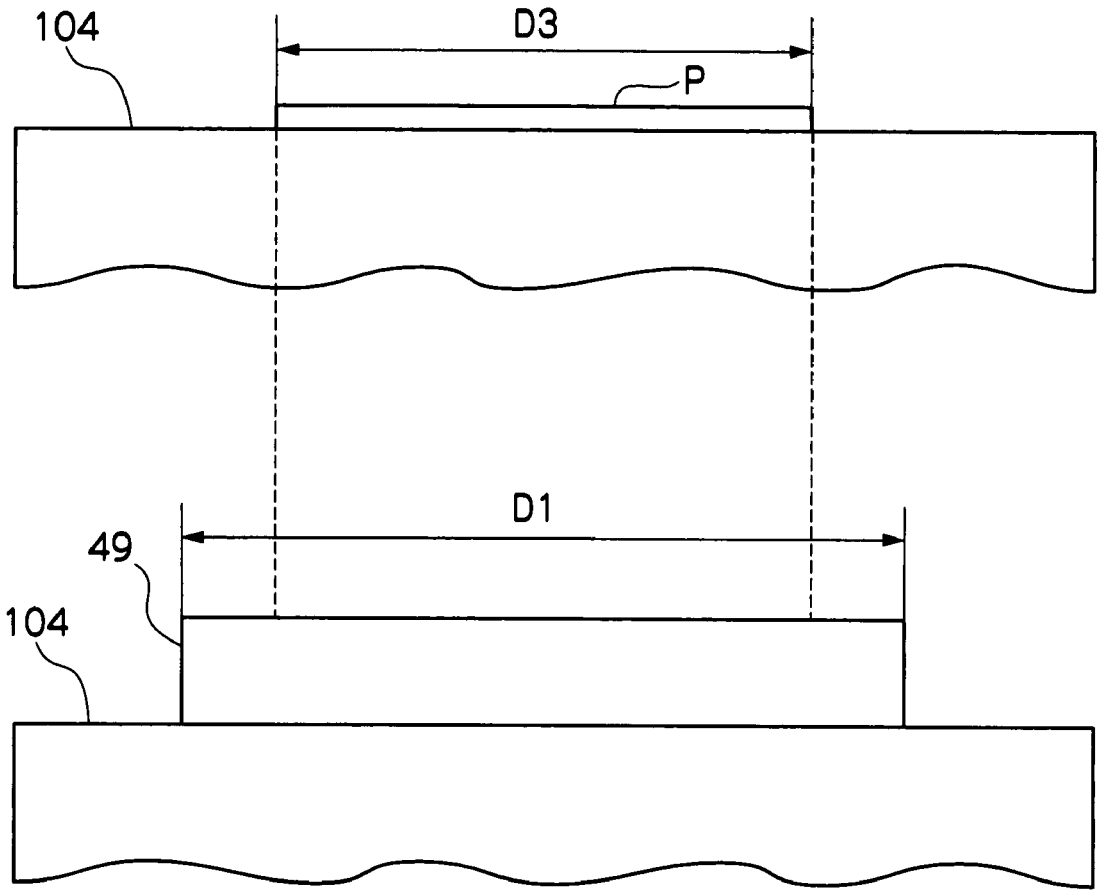
FIG. 12 is a diagram showing the relationship between the cleaning width of the blade D1, and the paper width D3 in an inkjet recording apparatus of the second exemplary embodiment of the present invention.

As shown in FIG. 12, in order to prevent soiling of the paper P due to ink mist adhering to the intermediate transfer drum 104, it is necessary that the width D3 of the paper P in the direction orthogonal to the conveying direction (referred to below as the paper width) and the cleaning width D1 satisfy the following formula (6).

$$D1 \geqq D3 \quad (6)$$

By the cleaning width D1 being the same as or greater than the paper width D3, ink mist adhered in the region of contact between the paper P and the intermediate transfer drum 104 is completely scraped off by the blade 49, and so soiling of the paper P by ink mist adhered to the intermediate transfer drum 104 may be prevented.

In the first and second exemplary embodiments ink jet recording apparatuses have been explained as examples of the present invention, however the invention is not limited to ink jet recording apparatuses, and may be applied to various industrial applications for general droplet ejection apparatuses such as: manufacturing of color filters for display use, by ejecting coloration ink onto polymer films; forming EL display panels by carrying out ejecting of organic EL liquid solutions onto substrates, and the like.

Also, for the "recording medium" for image recording in the droplet ejection apparatus of the invention, all objects and materials on which droplets may be ejected by a droplet ejection head are included. Therefore, while the recording medium of course may be recording paper and OHP sheets and the like, it also includes other objects and materials such as, for example, polymer films.

For the "droplet ejection head" of the droplet ejection apparatus of the present invention, all ejectors that eject droplets towards a recording medium or holding member are included. For example, ink jet recording heads that are smaller in length than the width of the paper P and that eject ink droplets by moving in the width direction of the paper P, and the like are included.

For the "conveying member" of the droplet ejection apparatus of the present invention, all members that retain and convey a recording medium are included. For example, drums that retain a recording medium on the peripheral surface thereof and rotate, and reciprocating tables that retain a recording medium and, and the like are included.

For the "conveying unit" of the droplet ejection apparatus of the present invention, all conveyers that contact a recording medium to a holding member and convey are included. For example, conveying rolls that nip and convey a recording medium, and the like are included.

For the "holding member (carrier)" of the droplet ejection apparatus of the present invention, all members that carry liquid ejected from a droplet ejection head are included. For example, rotating belts on which droplets are carried, and the like are included.

For the "cleaning members" of the droplet ejection apparatus of the present invention, all members that clean droplets adhered to conveying members are included. For example, cleaning rolls that contact the conveying member and rotate absorbing the droplets, and movable blades that contact the conveying member and move in a direction that intersects with the conveying direction, and the like are included.

For the "cleaning unit" of the droplet ejection apparatus of the present invention, all cleaners that clean droplets adhered to the holding member are included. For example, cleaning rolls that contact the holding member and rotate absorbing the droplets, and movable blades that contact the conveying member and move in a direction that intersects with the conveying direction, and the like are included.

For the "coating members" of the droplet ejection apparatus of the present invention, all members that coat onto a conveying member a lubricant are included. Included, for example, are: droplet ejection heads that eject such a lubricant towards a conveying member; webs that are impregnated with such a lubricant and contact with the conveying member; rolls that retain such a lubricant on the surface thereof, contact with the conveying member and rotate; and rolls that are impregnated with, or retain such a lubricant on the surface thereof, contact with the conveying member and move in a direction that intersects with the conveying direction.

For the "coating unit" of the droplet ejection apparatus of the present invention, all devices for coating onto a holding member a lubricant are included. Included, for example, are: droplet ejection heads that eject such a lubricant towards a holding member; webs that are impregnated with such a lubricant and contact with the holding member; rolls that retain such a lubricant on the surface thereof, contact with the holding member and rotate; and rolls that are impregnated with, or retain such a lubricant on the surface thereof, contact with the holding member and move in a direction that intersects with the conveying direction.

For the "charging unit" of the droplet ejection apparatus of the present invention, all devices for charging a conveying member are included. For example, corotrons that carry out non-contact charging of the conveying member are included.

Further, for the "charge removing unit" of the droplet ejection apparatus of the present invention, all devices for removing charge from a conveying member are included. For example, charge removing lamps that remove charge from the conveying member are included.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A droplet ejection apparatus comprising:

a droplet ejection head that ejects droplets;

a conveying member that retains a recording medium and conveys the recording medium with facing the recording medium to the droplet ejection head;

a coating member that coats the conveying member with a lubricant; and a cleaning member that cleans the conveying member, the droplet ejection apparatus satisfying the following formulae (1)

$$L2 \geqq L1 \quad (1)$$

wherein, in the formulae (1): L1 is the width, in the direction orthogonal to the conveying direction, of the cleaning of the conveying member by the cleaning member; and L2 is the width, in the direction orthogonal to the conveying direction, of coating the lubricant on the conveying member by the coating member.

2. The droplet ejection apparatus of claim 1, wherein a width L3 of the recording medium in the direction orthogonal to the conveying direction, and the width L1 satisfy the formula (2)

$$L1 \geqq L3 \quad (2).$$

3. The droplet ejection apparatus of claim 1, further comprising a charging unit that charges the conveying member, wherein the width L3 of the recording medium in the direction orthogonal to the conveying direction, and a width L4 that is the width, in the direction orthogonal to the conveying direction, of charging the conveying member by the charging unit, satisfy the following formula (3)

$$L4 \geqq L3 \quad (3).$$

4. The droplet ejection apparatus of claim 3, further comprising a charge removing unit that removes charge from the conveying member, wherein the width L4 and a width L5 that is the width, in the direction orthogonal to the conveying direction, of removing charge from the conveying member by the charge removing unit, satisfy the following formula (4)

$$L5 \geqq L4 \quad (4).$$

5. A droplet ejection apparatus comprising:

a droplet ejection head that ejects droplets;

a holding member that carries the droplets ejected from the droplet ejection head;

a transfer unit that transfers the droplets from the holding member to a recording medium;

a coating member that coats the holding member with a lubricant, and a cleaning member that cleans the holding member, the droplet ejection apparatus satisfying the following formulae (5)

$$D2 \geqq D1 \quad (5)$$

wherein, in the formulae (5): D1 is the width, in the direction orthogonal to the conveying direction, of the cleaning of the holding member by the cleaning member; and D2 is the width, in the direction orthogonal to the conveying direction, of coating the lubricant on the holding member by the coating member.

6. The droplet ejection apparatus of claim 5, wherein the width D3 of the recording medium in the direction orthogonal to the conveying direction, and the width D1 also satisfy the following formula (6):

$$D1 \geqq D3 \quad (6).$$

7. A droplet ejection apparatus comprising:

a droplet ejection head that ejects droplets;

a surface that receives the droplets ejected by the droplet ejection head;

a coating member that coats the surface with a lubricant; and a cleaning member that cleans the surface, the droplet ejection apparatus satisfying the following formulae (7).

$$K2 \geqq K1 \quad (7)$$

wherein, in the formulae (7): K1 is the width, in the direction orthogonal to the conveying direction, of the cleaning of the surface by the cleaning member; K2 is the width, in the direction orthogonal to the conveying direction, of the coating of the lubricant on the surface by the coating member.

8. The droplet ejection apparatus of claim 7, further comprising a conveying member that retains a recording medium and conveys the recording medium with facing the recording medium to the droplet ejection head, wherein the surface comprises the retaining face of the conveying member.

9. The droplet ejection apparatus of claim 8, wherein a width K3 of the recording medium in the direction orthogonal to the conveying direction, and the width K1 satisfy the following formula (8)

$$K1 \geqq K3 \quad (8).$$

10. The droplet ejection apparatus of claim 8, further comprising a charging unit that charges the conveying member, wherein a width K3 of the recording medium in the direction orthogonal to the conveying direction, and a width K4 that is the width in the direction orthogonal to the conveying direction that the charging unit charges the conveying member, satisfy the following formula (9)

$$K4 \geqq K3 \quad (9).$$

11. The droplet ejection apparatus of claim 10, further comprising a charge removing unit that removes charge from the conveying member, wherein the width K4 and a width K5 that is the width in the direction orthogonal to the conveying direction that the charge removing unit removes charge from the conveying member, satisfy the following formula (10)

$$K5 \geqq K4 \quad (10).$$

12. The droplet ejection apparatus of claim 7, further comprising: a holding member, the surface being the surface of the holding member; and a transfer unit that transfers the droplets from the surface of the holding member to a recording medium.

13. The droplet ejection apparatus of claim 12, wherein a width K3 of the recording medium in the direction orthogonal to the conveying direction, and the width K1 satisfy the following formula (11)

$$K1 \geqq K3 \quad (11).$$

14. A method of cleaning a droplet receiving surface, the method comprising:

moving a surface in a first direction;

coating the surface with a lubricant, the coating being at a width of K2 in a second direction that is a direction orthogonal to the first direction;

cleaning the surface, the cleaning being at a width of K1 in the second direction;

the formula K2≧K1 being satisfied.

15. The method of cleaning a droplet receiving surface of claim 14, wherein the surface comprises the retaining face of the conveying member.

16. The method of cleaning a droplet receiving surface of claim 14, further comprising: transferring the droplets from the surface to a recording medium.

* * * * *